US006664492B1

(12) United States Patent
Babb et al.

(10) Patent No.: US 6,664,492 B1
(45) Date of Patent: Dec. 16, 2003

(54) METHOD OF ELIMINATING ELECTRICALLY-CONDUCTIVE PARTICLES FROM AN AIRSTREAM

(75) Inventors: Samuel Martin Babb, Fort Collins, CO (US); Ronald Paul Dean, Fort Collins, CO (US); Jeffrey S. Weaver, Fort Collins, CO (US)

(73) Assignee: Hewlett-Packard Development Company, Houston, TX (US)

( * ) Notice: Subject to any disclaimer, the term of this patent is extended or adjusted under 35 U.S.C. 154(b) by 0 days.

(21) Appl. No.: 10/196,669

(22) Filed: Jul. 16, 2002

(51) Int. Cl.[7] ..... B03C 7/00; B03C 3/78; B03C 3/36

(52) U.S. Cl. ..... 209/127.1; 209/128; 96/48; 96/70; 55/523; 55/DIG. 39

(58) Field of Search ..... 96/48, 65, 70, 96/71, 62, 78, 75, 76; 209/127.1–129, 637

(56) References Cited

U.S. PATENT DOCUMENTS

| | | | | |
|---|---|---|---|---|
| 2,488,712 A | * | 11/1949 | Dahlman | 96/86 |
| 2,528,842 A | * | 11/1950 | Penney | 96/86 |
| 3,392,509 A | * | 7/1968 | Pelosi, Jr. | 96/66 |
| 3,678,653 A | * | 7/1972 | Buschman | 96/66 |
| 4,036,612 A | | 7/1977 | Guttmann | |
| 4,376,637 A | | 3/1983 | Yang | |
| 4,889,542 A | | 12/1989 | Hayes | |
| 5,559,673 A | | 9/1996 | Gagnon et al. | |
| 5,969,942 A | | 10/1999 | Heckner et al. | |
| 6,043,639 A | * | 3/2000 | Arrowsmith et al. | 324/71.4 |
| 2002/0162405 A1 | * | 11/2002 | Carbone et al. | 73/864.71 |
| 2002/0195956 A1 | * | 12/2002 | Molnar et al. | 315/169.2 |

OTHER PUBLICATIONS

"Zinc Whisker Abatement" [online] [Retrieved On: Jul. 15, 2002] Retrieved From: http://www.wes.net/crs–zinc_whiskers_detail.htm.

"Shaving Zinc Whiskers From Your Data Center" [online] [Retrieved On: Jul. 15, 2002] Retrieved From: http://www-.dataclean.com/noframe/zinc_whiskers.html.

"NASA Goddard Space Flight Center Tin Whisker Homepage" [online] [Retrieved On: Jul. 15, 2002] Retrieved From: http://nepp.nasa.gov/whisker/.

"Zinc Whiskers Growing on Raised Floor Tiles are Causing Conductive Contamination Failures and Equipment Shutdowns" [online] [Retrieved On: Jul. 15, 2002] Retrieved From: http://www.upsite.com/TUIpages/tuiflashzinc.html.

* cited by examiner

*Primary Examiner*—Donald P. Walsh
*Assistant Examiner*—Jonathan R. Miller

(57) ABSTRACT

Disclosed are systems and methods for removing electrically-conductive contaminants entrained in airstream. The airstream is preferably redirected to separate the electrically-conductive contaminants from the airstream. The separated electrically-conductive contaminants may then be oxidized.

22 Claims, 2 Drawing Sheets

METHOD OF ELIMINATING ELECTRICALLY-CONDUCTIVE PARTICLES FROM AN AIRSTREAM

CROSS-REFERENCE TO RELATED APPLICATIONS

The patent application is related to co-pending and commonly assigned U.S. patent application Ser. No. 10/126,635 filed Apr. 20, 2002, and entitled "Electrostatic Precipitation for Removing Fine Whiskers from Cooling Air for Electronics Systems" the disclosure of which is hereby incorporated herein by reference.

FIELD OF THE INVENTION

The present invention relates to systems and methods for removing conductive airborne contaminants, and more particularly, to eliminating electrically-conductive particles from an airstream.

BACKGROUND OF THE INVENTION

Airborne conductive contaminants can cause failure or malfunction of electrical and computer equipment, such as to short-circuit or cause other undesired circuit perturbation. Equipment, such as power supplies, that utilize forced air cooling and have high densities of electrical circuits with high voltages across small node gaps are particularly susceptible to malfunction associated with the presence of conductive contaminants.

Electrically-conductive airborne contamination may include metallic particulates, whiskers and shards, fragments of wires, and fibers used in anti-static floor coverings. For example, these electrically-conductive contaminants may have a diameter of about 1–2 microns and a length of about 0.5–5 mm, resulting in a particulate which is easily airborne. These particulates often become entrained in the airflow used to cool the electrical equipment. Metal whiskers are particularly hazardous to electrical equipment because the whiskers are extremely light and are therefore readily entrained in and transported by cooling air flows. These whiskers can grow on surfaces found in computer room environments, e.g. electroplated zinc surfaces, such as are present on the undersides of raised floor tiles, inside air-conditioning ducts and on the equipment chassis.

The electrically-conductive airborne contaminants, such as zinc whiskers or particles, often grow on metal stringers or off the bottom and sides of the floor tiles that have a zinc electroplated-passivation coating on the sheet-metal pan. These whiskers can grow to a length of well over 2000 microns (2 mm) if left undisturbed for several years, and may be dislodged when the tiles are removed to gain access to the under-floor area. For example, as floor tiles are moved or disturbed thousands of whiskers from the under side of the tile may be stripped off, and the normal airflow in the data center causes the contamination to quickly spread throughout the center. Also, movement of cables and equipment under the floor can dislodge the whiskers. Power supply fans, cooling blowers, and the like in the computer equipment then draw the whiskers into the internal logic cages and power supplies of the equipment. Once inside the computer equipment, the whiskers lodge themselves in the electronic components of logic cards and power supplies causing either a voltage or signal perturbation.

A whisker can be considered a low-capacity fuse with Direct Current (DC) resistance of 10 ohms to 40 ohms, depending on the whisker geometry, with a DC fusing current of 10 mA to 30 mA. When sensitive electronic equipment becomes contaminated with zinc whiskers, equipment failures and system resets can occur. In most cases, the same short circuit caused by the whisker either vaporizes the contaminating whisker by the current flow creating an arc path across adjacent etchings on the circuit board. Alternatively, the whisker may become dislodged when the circuit board or card is removed, thereby leaving definite fault analysis virtually impossible.

A typical long-term remediation or abatement process requires replacing the affected floor panels. Although, the panels can be cleaned, the whiskers typically grow back. Therefore, without proper equipment, personnel and procedures, the likelihood of sustained success is low. Generally, the remediation and abatement process involves the redirection and reduction of airflow, removal of contaminated floor tiles (individually bagged), cleaning of the air plenum (such as by using High Efficiency Particle Arresting vacuums), cleaning and sealing unmovable tiles, and installing new tiles. However, sealing or painting the bottoms of the panels may be ineffective since the whiskers can grow through most coatings.

Another method of removing airborne contaminants from the airstream is to utilize filters. Such filters are generally designed with an assembly of very small obstacles such as fibers or spheres, integrally bound together or a loosely-bound aggregate through which the dirty or contaminated air flows. However, the filters significantly increase air impedance, thereby restricting airflow. Additionally, the filter needs to be replaced or cleaned periodically to remove captured or collected contaminated airborne particles to prevent further restriction of the airflow.

BRIEF SUMMARY OF THE INVENTION

Preferred embodiments of the present invention provide systems and methods for removing electrically-conductive contaminants entrained in an airstream by redirecting the airstream to separate the electrically-conductive contaminants from the airstream and oxidizing the separated electrically-conductive contaminants.

DETAILED DESCRIPTION

Figure 1A:
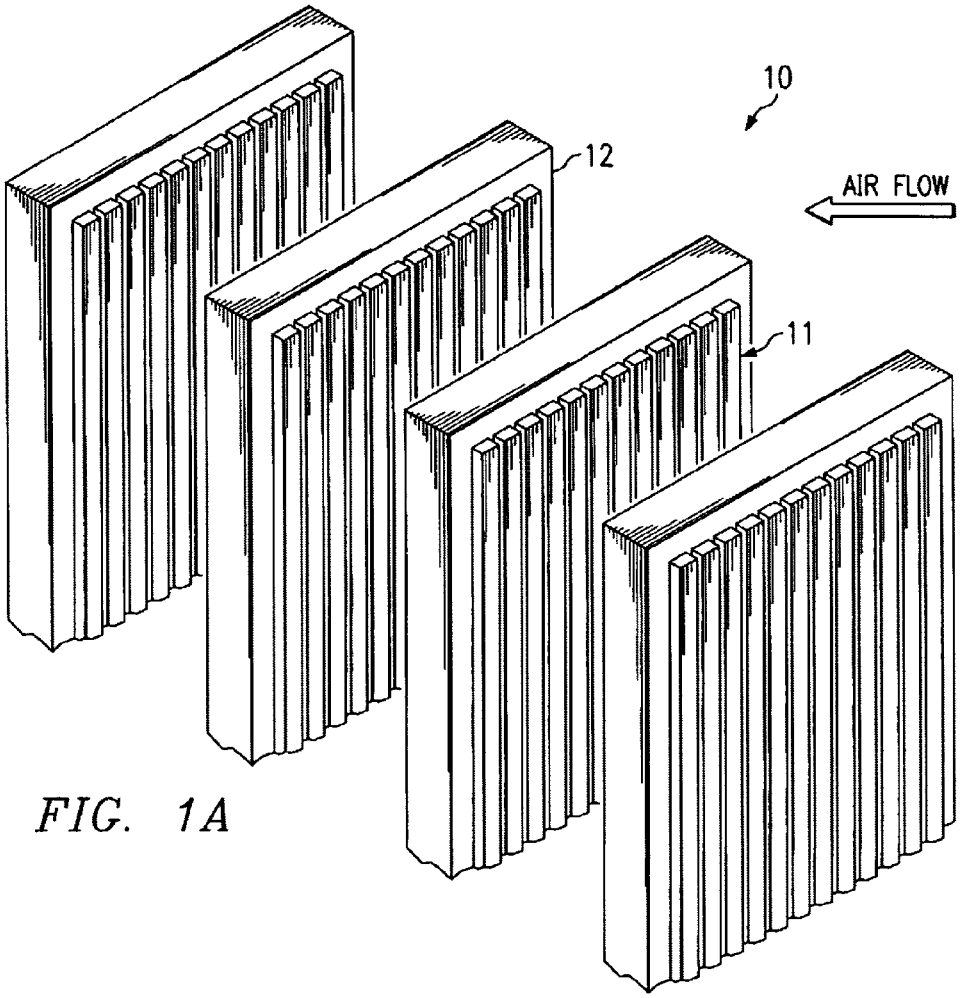
FIGS. 1A–1B are schematic representation of an embodiment of an apparatus in accordance with the present invention.
Figure 1B:
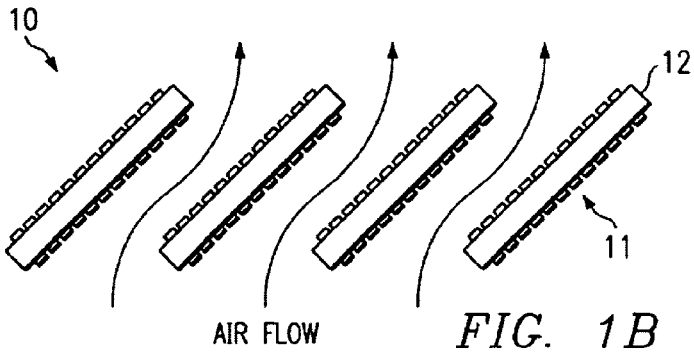

In accordance with an embodiment of the present invention, apparatus 10 shown in FIGS. 1A and 1B comprises one or more air baffles 12 to change the direction of the airflow or airstream. This change in airflow direction is preferably adapted to separate the electrically-conductive contaminants entrained in the airstream. According to a preferred embodiment of the invention, a grid of electrical conductors 11, preferably disposed in association with air baffles 12, operate to oxidize the electrically-conductive contaminants separated from the airstream.

The preferred embodiment configuration of air baffles and electrical conductors remove airborne contaminants without restricting or impeding the flow of the airstream. That is, apparatus 10 reduces or eliminates the zinc particles or other electrically-conductive contaminants from the airstream by changing the direction of the airstream and forcing the heavier electrically-conductive contaminants to come in contact with electrical grid 11 (e.g. due to the momentum of the contaminants resisting the change in direction experienced by the airstream). Upon contact with electrical grid 11, the electrically-conductive contaminants are preferably oxidized or burned, thereby rendering the electrically-conductive contaminants non-conductive to the electronic components in the computer or electrical equipment.

In accordance with an aspect of one embodiment of the present invention, electric grid 11 is placed in close proximity to baffle 12, preferably electric grid 11 is placed on the front of (or in front of) baffle 12. This facilitates close spacing of the conductors in electric grid 11 (e.g. spaced closely enough to achieve oxidization of the smallest particulate matter expected to cause circuit perturbation) without impeding the flow of the airstream. This additionally facilitates operation of apparatus 10 of the present invention at low voltage, e.g., around 20 volts or other relatively low voltage, such as a voltage readily available from a system power supply, a voltage low enough to avoid arching between electrical conductors of grid 11, etc., to oxidize the electrically-conductive contaminants, thereby reducing or eliminating the shorting potential of the electrically-conductive airborne contaminants without restricting or impeding the flow of the airstream.

In accordance with an embodiment of the present invention, apparatus 10 is placed within the cooling airstream of the electrical or computer equipment. For example, apparatus 10 is disposed within a cooling inlet of a power supply unit or within the computer equipment housing in place of the air vent or louver. Alternatively, apparatus 10 may be placed before or after an air vent or louver or at any other position in the air stream.

Apparatus 10 of the preferred embodiment operates isokinetically at all flow speeds since the air stream is not restricted or attenuated, the airstream is merely temporarily redirected as shown in FIG. 1B. Since the electrically-conductive contaminants are oxidized according to the preferred embodiment, there is no buildup of contaminants as with existing filters. Therefore, apparatus 10 of the present invention removes or reduces the electrically-conductive contaminants from the airstream without restricting or impeding the flow of the airstream.

Figure 2:
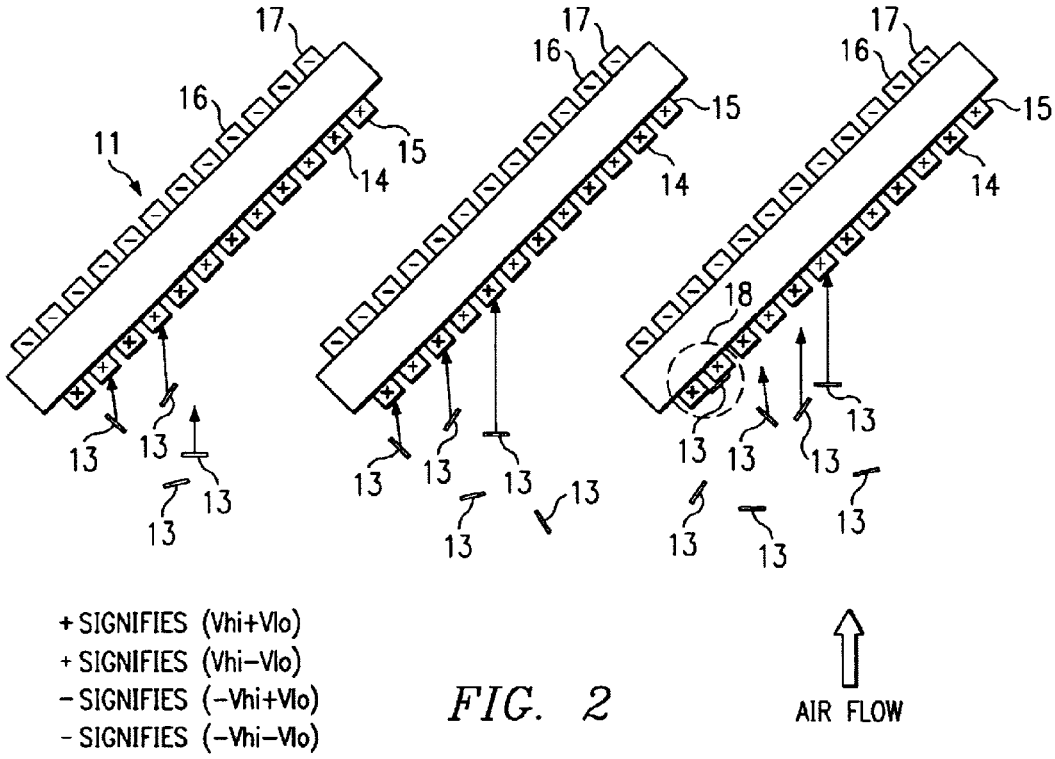
FIG. 2 is schematic representation of an embodiment of an electric grid in accordance with the present invention.

Turning now to FIG. 2, there is illustrated an example of electric grid 11 in accordance with an embodiment of the present invention which can operate with or without baffle 12, or can be incorporated onto baffle 12 (e.g. electric grid 11 may be configured to provide a change in direction of the air stream without including a separate baffle structure). Electric grid 11 is composed of multiple electrodes 14, 15, 16 and 17 representing various combinations of the high-voltage bipolar (both positive and negative outputs) supply (referred to herein as "Vhi") and the low-voltage bipolar supply (referred to herein as "Vlo") connections as shown in FIG. 2. For example, the high-voltage bipolar supply can have an operating range of 10V to 1000V and the low-voltage bipolar supply can have an operating range of 0V to 10V, although any voltages providing a potential difference sufficient for neutralizing the electrically-conductive contaminates may be used according to the present invention. Electrode 14 depicted with a "+" symbol (boldface) in FIG. 2 has an output voltage of Vhi+Vlo, electrode 15 depicted with a "+" symbol has an output voltage of Vhi−Vlo, electrode 16 depicted with a "−" symbol (boldface) has an output voltage of −Vhi+Vlo and electrode 17 depicted with a "−" symbol has an output voltage of −Vhi−Vlo.

The various combinations of electrodes 14, 15, 16 and 17 preferably generate an electric field to help attract electrically-conductive contaminants 13 entrained in the airstream. Accordingly, electric grid 11 of the illustrated embodiment is biased to attract electrically-conductive contaminants 13 entrained in the airstream. Biasing of the electrical grid is preferably used in combination with the aforementioned change in direction of the airflow to maximize the electrically-conductive particulate matter removed by operation of the present invention.

Circled area 18 in FIG. 2 shows an electrically-conductive contaminant or whisker 13 in contact with electrodes 14 and 15. Upon contact, electrically-conductive contaminant 13 is preferably oxidized or burned by electrodes 14 and 15 of grid 11 (e.g. conductive contaminant 13 operates as a fuse link between electrodes 14 and 15). Any particulate matter remaining after oxidization of an electrically-conductive contaminant by the present invention is preferably not itself electrically-conductive and/or is substantially reduced in size and, therefore, may be later borne by the airflow past sensitive electrical components.

Figure 3:
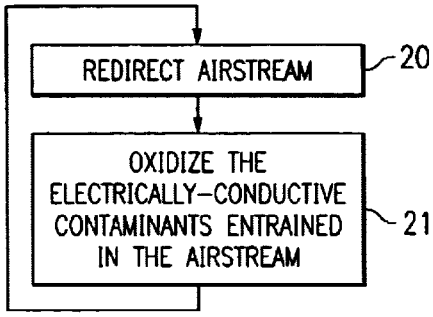
FIG. 3 is a flow chart that illustrates an exemplary embodiment of a process for implementing the present invention.

The process of removing or eliminating the electrically-conductive contaminants entrained in the airstream, such as the inlet cooling airstream of an electrical or computer equipment, in accordance with an embodiment of the present invention is described in conjunction with FIG. 3. In step 20, the airstream is redirected to separate the electrically-conductive contaminants entrained in the airstream. That is, the airstream is redirected such that the heavier electrically-conductive contaminants entrained in the airstream come into contact with electric grid 11. Preferably, one or more air baffles 12 is used to redirect the airstream. In step 21, electric grid 11 oxidizes or burns the electrically-conductive contaminants, thereby reducing or eliminating the shorting potential of the electrically-conductive contaminants without restricting or impeding the flow of the airstream. The steps 20 and 21 are preferably repeated until the computer equipment is powered off.

What is claimed is:

1. A method of removing electrically-conductive contaminants entrained in airstream, said method comprising:

redirecting the airstream to separate said electrically-conductive contaminants from the airstream; and oxidizing said separated electrically-conductive contaminants.

2. The method of claim 1, wherein said electrically-conductive contaminants comprise metallic whiskers.

3. The method of claim 1, wherein said electrically-conductive contaminants comprise zinc particles.

4. The method of claim 1, wherein the airstream is an inlet cooling air stream within a computer equipment.

5. The method of claim 1, wherein said oxidizing oxidizes said electrically-conductive contaminants using an electric grid.

6. The method of claim 5, wherein said electric grid comprises electrodes spaced apart a distance determined to facilitate oxidation of a smallest particulate size expected to cause circuit perturbation.

7. The method of claim 1, wherein said redirecting redirects the airflow using at least one air baffle.

8. An apparatus for removing electrically-conductive contaminants entrained in an airstream, said apparatus comprising:

at least one baffle for redirecting the airstream and separating said electrically-conductive contaminants from the airstream; and an electric grid for oxidizing said electrically-conductive contaminants separated from the airstream.

9. The apparatus of claim 8, wherein said electrically-conductive contaminants are metallic whiskers.

10. The apparatus of claim 8, wherein said electrically-conductive contaminants are zinc particles.

11. The apparatus of claim 8, wherein the airstream represents inlet cooling air stream within a computer equipment.

12. The apparatus of claim 8, wherein said electric grid is placed on or in front of said air baffle.

13. The apparatus of claim 8, wherein said electric grid is biased to attract said electrically-conductive contaminants.

14. The apparatus of claim 8, wherein said electric grid comprises electrodes spaced apart a distance determined to facilitate oxidation of a smallest particulate size expected to cause circuit perturbation.

15. The apparatus of claim 8, wherein said apparatus is disposed within a cooling path of electrical equipment in place of an equipment housing louver.

16. The apparatus of claim 8, wherein said apparatus is disposed within a cooling path of electrical equipment in addition to an equipment housing louver.

17. A system for removing electrically-conductive contaminants entrained in airstream, said system comprising:

at least one electric grid for oxidizing electrically-conductive contaminants; and at least one baffle for redirecting the airstream to bring said electrically-conductive contaminants entrained in the airstream in contact with at least one electric grid.

18. The system of claim 17, wherein said at least one electric grid and said at least one baffle are disposed such that said redirecting the air stream and said oxidizing the electrically-conductive contaminants are accomplished without attenuating the flow of the airstream.

19. The apparatus of claim 17, wherein said electrically-conductive contaminants are metallic whiskers.

20. The apparatus of claim 17, wherein the airstream represents inlet cooling air stream within a computer equipment.

21. The apparatus of claim 17, wherein said electric grid is placed on front of or in front of said air baffle.

22. The apparatus of claim 17, wherein said electric grid is biased to attract said electrically-conductive contaminants.

* * * * *